US007366433B2

(12) United States Patent
Suzuki et al.

(10) Patent No.: US 7,366,433 B2
(45) Date of Patent: Apr. 29, 2008

(54) IMAGE FORMING APPARATUS THAT PRINTS ON THE BASIS OF THE RECORDING SHEET SIZE

(75) Inventors: Takaaki Suzuki, Shizuoka-ken (JP); Takaharu Ouchi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 200 days.

(21) Appl. No.: 11/182,406

(22) Filed: Jul. 15, 2005

(65) Prior Publication Data

US 2007/0014581 A1 Jan. 18, 2007

(51) Int. Cl.
*G03G 15/00* (2006.01)

(52) U.S. Cl. ..... 399/45

(58) Field of Classification Search ..... 399/45, 399/46, 381, 389, 394; 347/14, 17, 19
See application file for complete search history.

(56) References Cited

U.S. PATENT DOCUMENTS 6,846,056 B2 * 1/2005 Jacobsen et al. ..... 347/14

FOREIGN PATENT DOCUMENTS

JP 2004-123366 4/2004

* cited by examiner

*Primary Examiner*—Hoang Ngo
(74) *Attorney, Agent, or Firm*—SoCal IP Law Group LLP; Steven C. Sereboff; John E. Gunther

(57) ABSTRACT

An image forming apparatus may include an image acquiring section for acquiring the image to be printed, an attribute information acquiring section for acquiring attribute information of the recording sheet to be used for printing the image acquired by the image acquiring section from the IC tag attached to the recording sheet and storing the attribute information, a printing control section for controlling the operation of printing the image so as to make the image match the attributes of the recording sheet on the basis of the attribute information acquired by the attribute information acquiring section and an image printing section for printing the image under the control of the printing control section.

8 Claims, 4 Drawing Sheets

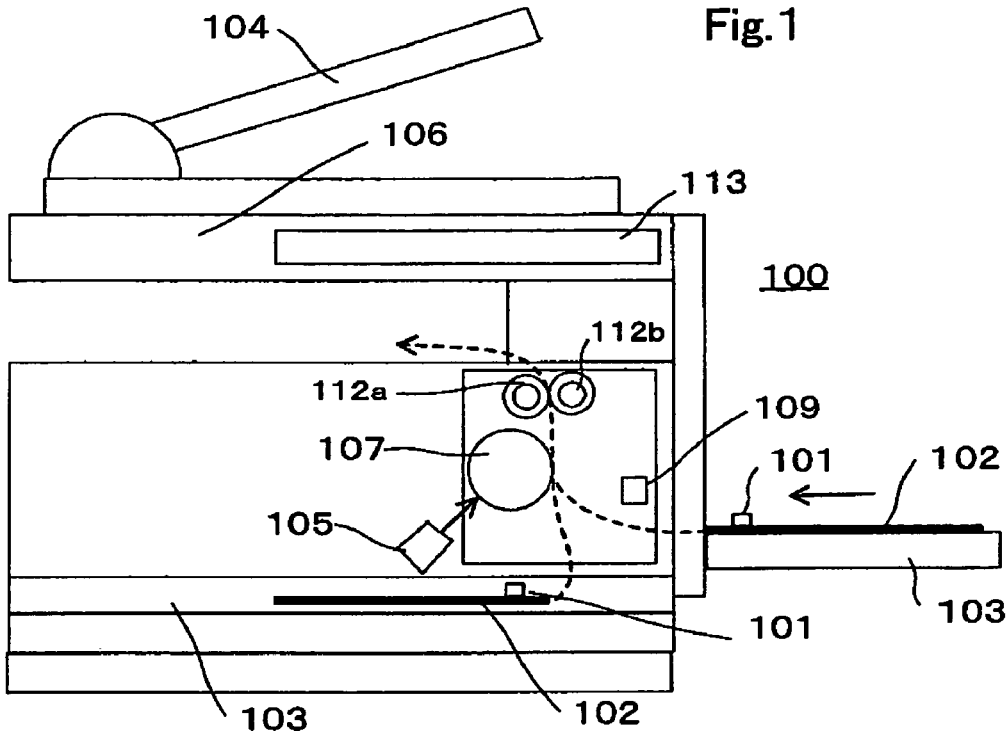
Fig. 1
Fig. 2
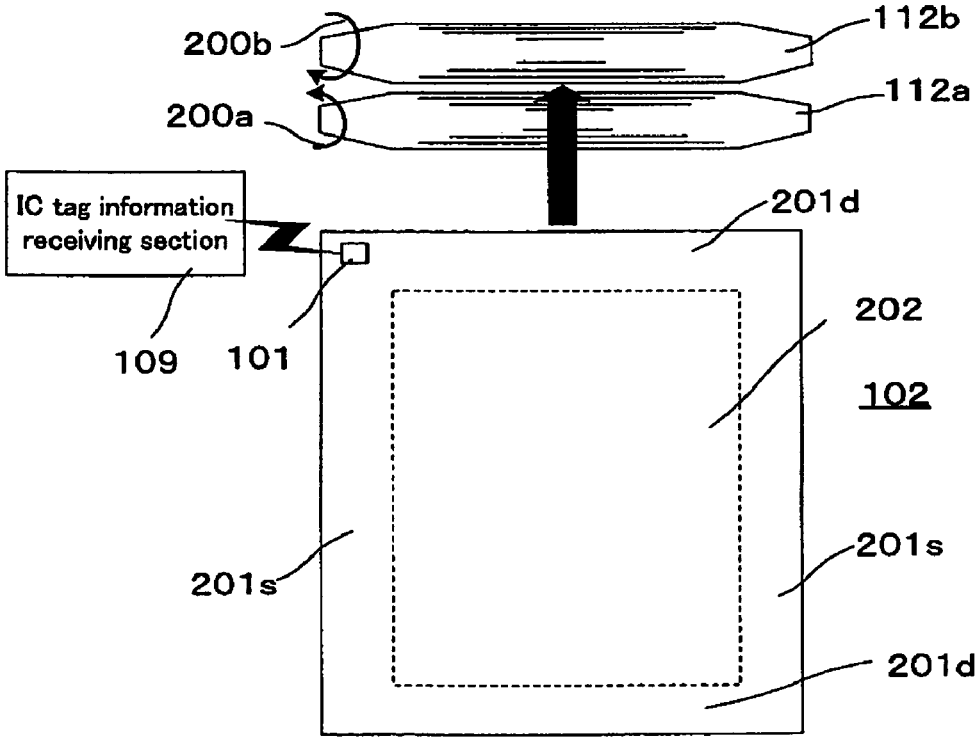

IMAGE FORMING APPARATUS THAT PRINTS ON THE BASIS OF THE RECORDING SHEET SIZE

BACKGROUND OF THE INVENTION

1. Field of the Invention

This invention relates to an image forming apparatus for printing an image on a recording sheet that may be a sheet of plain paper.

2. Description of the Related Art

With image forming apparatus such as electronic copying machines, generally an electrostatic latent image is formed and then turned into a visible image, which visible image is subsequently printed onto a recording sheet of a predetermined size. Recording sheets of several given sizes are commercially available and a good printed image may be obtained if the visible image matches any of the given sizes of recording sheet. However, if the visible image does not match any of the given sizes of recording sheet, the size of recording sheet that is required for the printing has to be input to the image forming apparatus. With conventional image forming apparatus, the user is required to manually input the need of using one or more than one recording sheets that are out of any of the given sizes when the user wants to use such recording sheets. However, such a manual input operation is cumbersome particularly when recording sheets that are out of any of the given sizes have to be used frequently.

Additionally, the quality can differ significantly among recording sheets and there are various degrees of whiteness of recording sheets. In ordinary image forming apparatus, the printing density is selected on the basis of the average degree of whiteness of recording sheets. However, it is desirable to regulate the printing density so as to make it match the quality of the recording sheet to be used for printing. Additionally, while plane paper is normally used for recording sheets, it is necessary to change the printing density when an image is to be printed on a recording sheet that is different from plane paper such as an OHP sheet. Then, the quality of the recording sheet has to be manually input to the image forming apparatus to make the printing operation a cumbersome one.

Devices that comprise an information transmission means (RFID) for transmitting information on the size of the recording sheets contained in a sheet cassette in a non-contact manner is known (Japanese Patent Application Laid-Open Publication No. 2004-123366). However, no device that can acquire detailed attribute information on each recording sheet to be used for printing and automatically regulate the printing operation on the basis of the acquired information is known.

SUMMARY OF THE INVENTION

The present invention provides an image forming apparatus that can automatically regulate a printing operation on the basis of the size and the quality of the recording sheet to be used for printing.

An image forming apparatus according to the invention is adapted to operate with recording sheets, each having an IC tag storing attribute information of the recording sheet, and regulate the printing operation to be conducted on a recording sheet by comparing the information read out from the IC tag and the information on the image to be recorded on the recording sheet.

In an aspect of the present invention, there is provided an image forming apparatus comprising: an image acquiring section for acquiring the image to be printed; an attribute information acquiring section for acquiring attribute information of the recording sheet to be used for printing the image acquired by the image acquiring section from the IC tag attached to the recording sheet and storing the attribute information; a printing control section for controlling the operation of printing the image so as to make the image match the attributes of the recording sheet on the basis of the attribute information acquired by the attribute information acquiring section; and an image printing section for printing the image under the control of the printing control section.

BRIEF DESCRIPTION OF THE DRAWINGS

FIG. 1 is a schematic cross sectional lateral view of an embodiment of image forming apparatus according to the invention, showing the overall configuration thereof;

FIG. 2 is a schematic illustration of the IC tag arranged on a sheet of paper to be used with the above embodiment of image forming apparatus, the pair of fixing rollers of the embodiment and the relationship between the IC tag and the IC tag information receiving section;

DETAILED DESCRIPTION OF THE INVENTION

Now, the present invention will be described in greater detail by referring to the accompanying drawings that illustrate preferred embodiments of the invention.

First Embodiment

Figure 3:
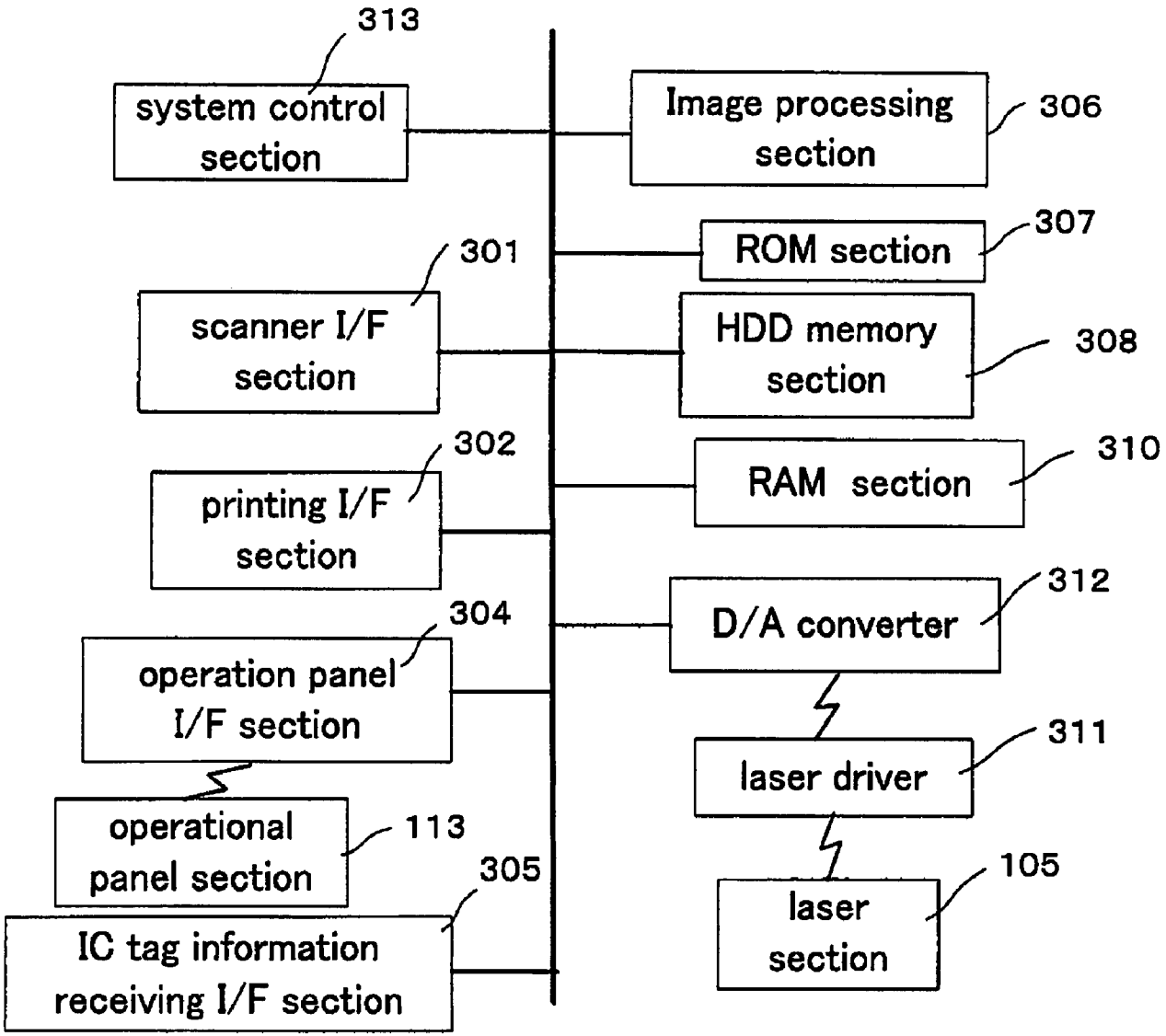
FIG. 3 is a schematic block diagram of the electric components of the above embodiment of image forming apparatus.

Firstly, an embodiment of the present invention to be used with a recording sheet carrying an IC tag will be described. FIG. 1 is a schematic cross sectional lateral view of the embodiment, showing the overall configuration thereof. FIG. 2 is a schematic illustration of the IC tag arranged on a recording sheet (sheet of paper) to be used with this embodiment, the pair of fixing rollers of the embodiment and the relationship between the IC tag and the IC tag information receiving section. FIG. 3 is a schematic block diagram of the electric components of the above embodiment of image forming apparatus.

Referring to FIG. 1, the image forming apparatus 100 structurally comprises a sheet feeding cassette section 103 for feeding a sheet of paper 102 on which an IC tag 101 is applied, an automatic document feeder (ADF) 104 for automatically feeding the original to be copied, a scanner section 106 for scanning the original, a laser section 105 for receiving the digital signal representing the optical image obtained by scanning the original by means of a CCD sensor and emitting a laser beam according to the signal, a photosensitive drum 107 for forming an electrostatic latent image by means of the laser beam, an IC tag information receiving section 109 for acquiring attribute information of the sheet of paper 102 from the IC tag 101 arranged on the sheet of paper 102, a pair of fixing roller 112*a*, 112*b* for fixing a visible image that is optimally regulated according to the information acquired by the IC tag information receiving section 109 and an operation panel section 113 to be used for specific input operations.

As for the electric system of the image forming apparatus 100 as shown in FIG. 3, the apparatus 100 comprises a scanner I/F section 301 that operates as interface relative to the scanner section 106, a printing I/F section 302 that operates as interface relative to the printing section of the apparatus including the above described fixing rollers 112*a*, 112*b* and adapted to print an image on the sheet of paper 102, an operation panel I/F section 304 that operates as interface relative to the operation panel section 113, an IC tag information receiving I/F section 305 that operates as interface relative to the IC tag information receiving section 109, an image processing section 306 for regulating the image to be printed on the sheet of paper so as to print an optimal image according to the attribute information relating to the sheet of paper that is acquired by way of the IC tag information receiving I/F section 305, a ROM section 307 storing control programs, an HDD memory section 308 storing image data, a RAM section 310 that is utilized by the control programs to temporarily store various pieces of information, a laser driver 311 for controlling the intensity of the laser beam emitted from the laser section 105, a D/A converter 312 for supplying a control input from the laser driver 311 and a system control section 313 for controlling the overall operation of the apparatus.

The sheet of paper 102 on which an image is printed is not used to the edges for printing. In other words, as shown in FIG. 2, the sheet of paper 102 has lateral and upper and lower non-printing areas 201*s*, 201*d* and an image is printed on the sheet of paper 102 in the printing area 202 that is defined by excluding the non-printing areas 201*s*, 201*d* from the sheet of paper 102. Normally, the non-printing areas are defined by the size of the sheet of paper 102 and the mechanical structure of the image forming apparatus and hence the printing area 202 is also defined automatically.

The fixing rollers 112*a*, 112*b* are driven to rotate respectively in the directions indicated by arrows 200*a*, 200*b*. The fixing rollers 112*a*, 112*b* shows an outwardly tapered outer profile such that, while the fixing rollers 112*a*, 112*b* contact the sheet of paper 102 in the printing area 202, they do not contact the sheet of paper 102 in the lateral non-printing areas 201*s*. On the other hand, the IC tag 101 is applied to the sheet of paper 102 in an upper left part where one of the non-printing areas 201*s* and the upper non-printing area 201*d* overlaps each other. The IC tag information receiving section 109 for receiving a signal from the IC tag is arranged at a position located at the corresponding lateral side of the passing route of the sheet of paper 102.

Since the paired fixing rollers 112*a*, 112*b* have a structure as described above and the IC tag 101 is arranged at the above defined position, the IC tag 101 does not influence the operation of printing an image on the sheet of paper 102. In other words, no pressure is applied to the IC tag by the fixing rollers and hence the IC tag is prevented from being destroyed by the fixing rollers. Additionally, since the IC tag 101 that is applied to the sheet of paper passes near the IC tag information receiving section 109, it is easy for the latter to read out the attribute information relating to the sheet of paper 102 that is stored in the IC tag 101.

The IC tag arranged at the upper left corner of the sheet of paper 102 stores the longitudinal and transversal lengths of the sheet of paper 102.

Figure 4:
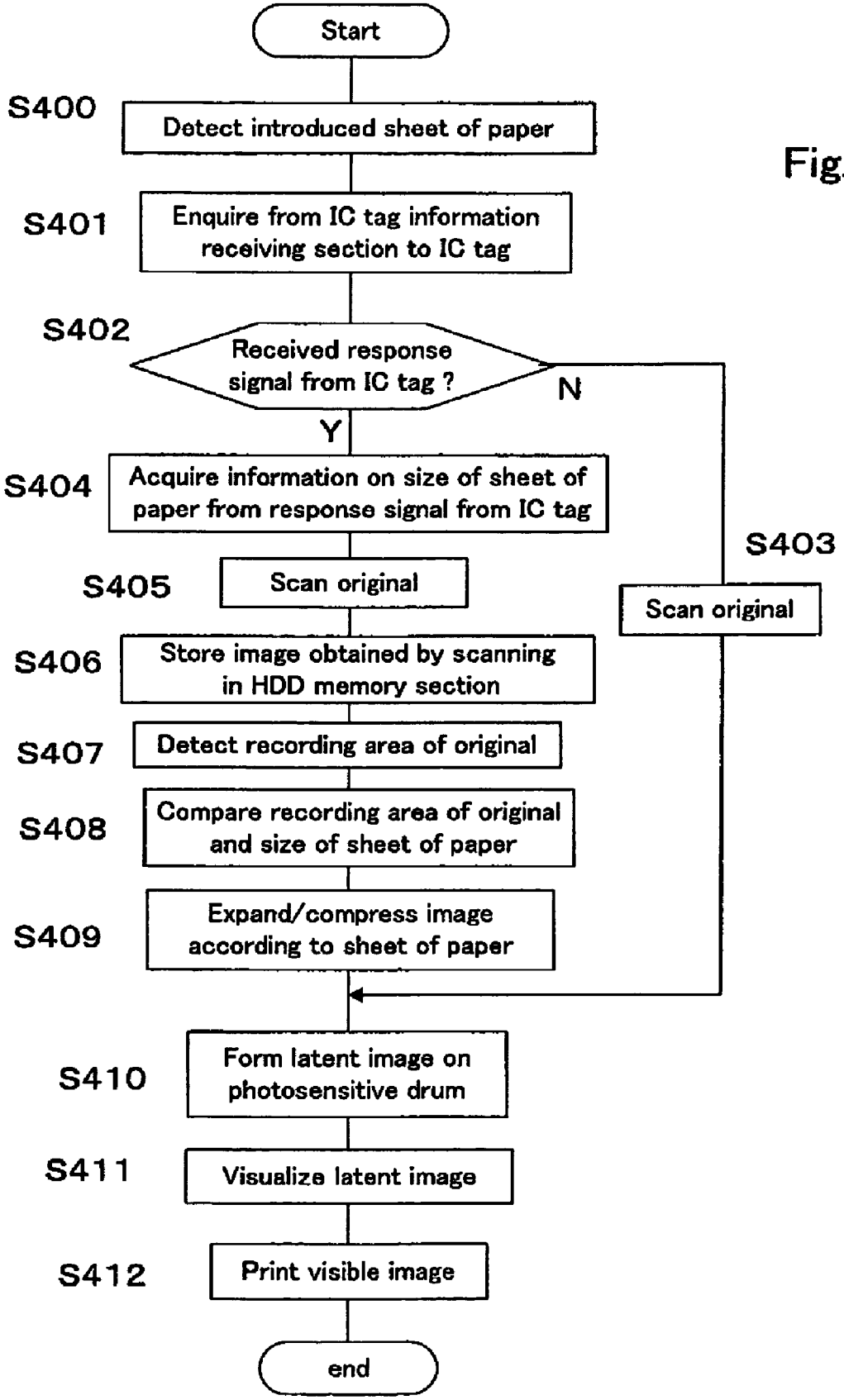
FIG. 4 is a flow chart of the operation of the above embodiment of image forming apparatus.

Now, the operation of the embodiment of image forming apparatus will be described below by referring to the flow chart of FIG. 4. The control sequence of the operation is roughly stored in the ROM section 307 and the system control section 313 controls the overall operation according to the control program stored in the ROM section 307. As the sheet of paper 102 is introduced from the sheet feeding cassette section 103 by means of a manual operation, for example, the system control section 313 detects the sheet of paper 102 by means of a detector (not shown) in Step S400. As the introduced sheet of paper is detected and if the sheet of paper carries an IC tag, the IC tag information receiving section 109 transmits an enquiry signal asking for attributes of the sheet of paper 102 to the IC tag 101 after the elapse of a predetermined time period when the IC tag information receiving section 109 is located closest to the IC tag 101 (Step S401).

If the sheet of paper 102 does not carry any IC tag, no response signal will be sent from any IC tag in response to the enquiry signal from the IC tag information receiving section 109 as a matter of course. Therefore, if the sheet of paper 102 carries an IC tag or not is detected in Step S403 depending on if a response signal is sent from an IC tag or not.

When no IC tag 101 is fitted to the sheet of paper 102, the system control section 313 determines that the sheet of paper has a given predetermined size and moves to Step S403, where it conducts an ordinary printing operation of scanning the original, acquiring an optical image, converting it into an electric image and then into a visible image that is to be performed on a sheet of a given predetermined size (Steps S410 through S412, which will be described in greater detail hereinafter).

It may alternatively be so arranged that the system control section 313 displays a message asking the size of the sheet of paper on the operation panel section 113 by way of the operation panel I/F section 304 so as to prompt the operator to input the size of the sheet of paper. Still alternatively, it may be so arranged that the system control section 313 roughly measures the size of the sheet of paper by some means and displays the message on the operation panel section 113 only when it is determined that the sheet of paper is not of the given predetermined size.

If, on the other hand, there is a response signal transmitted from the IC tag 101 and received by the IC tag information receiving section 109, the system control section 313 acquires information on the size of the sheet of paper 102 out of the response signal from the IC tag 101 in Step S404. The information on the size of the sheet of paper 102 may tell the actual longitudinal and transversal lengths of the sheet of paper or those of the printing area of the sheet of paper. If sizes of sheet of paper that do not agree with the given predetermined size but can be accepted by the image forming apparatus are limited, the information may be a sign or a number that represents the acceptable size. The information on the sizes of the sheet of paper is then temporarily stored in the RAM section 310.

In the next step, or in Step S405, the scanning section 106 scans the original to be copied. The optical image that is obtained by the scanning operation is then converted into an electric image and, in Step S406, it is taken in by way of the scanner I/F section 301 and stored in the HDD memory section 308. In Step S407, the longitudinal and transversal lengths of the recorded area of the original are detected from the image stored in the HDD memory section 308 and, in Step S408, the recorded area of the original and the size of the sheet of paper acquired in Step S404 and stored in the RAM section 310 are compared with each other under the control of the system control section 313.

In Step S409, the image obtained by the scanning operation is read out from the HDD memory section 308 and subsequently read into the image processing section 306, where the image obtained by the scanning operation is, if necessary, expanded or compressed act the size of the sheet of paper so that the image may be snugly printed in the printing area of the sheet of paper (Step S409). It is possible to fixedly use the ratio of the longitudinal length to the transversal length of the original or specify the longitudinal length and the transversal length independently when expanding or compressing the image.

The image obtained as a result of the expansion or compression is then stored again in the HDD memory section 308. Then, the image obtained as a result of the expansion or compression is read out from the HDD memory section 308 and, in Step S410, an electrostatic latent image that corresponds to the read out image is formed on the photosensitive drum 107. The electrostatic latent image that is formed on the photosensitive drum is then turned into a visible image typically by means of toner (Step S411).

In Step S412, the visualized toner image is transferred onto the sheet of paper 102 by printing under the control of the system control section 313 by way of the printing I/F section 302.

Thus, this embodiment provides an advantage that an image is printed on a sheet of paper with a size that matches the size of the sheet of paper that is stored in the IC tag carried by the sheet of paper.

Second Embodiment

Now, another embodiment of the present invention will be described below. This embodiment is characterized in that the degree of whiteness of the sheet of paper to be used for printing an image is stored as attribute information in the IC tag carried by the sheet of paper. The overall configuration of this embodiment is same as the one illustrated in FIG. 1. The configuration of the electric system of the embodiment is also same as the one illustrated in FIG. 3. The relationship between the sheet of paper 102 and the pair of fixing rollers 112*a*, 112*b* of this embodiment and the relationship between the IC tag 101 and the IC tag information receiving section 109 of this embodiment are also same as those illustrated in FIG. 2.

Figure 5:
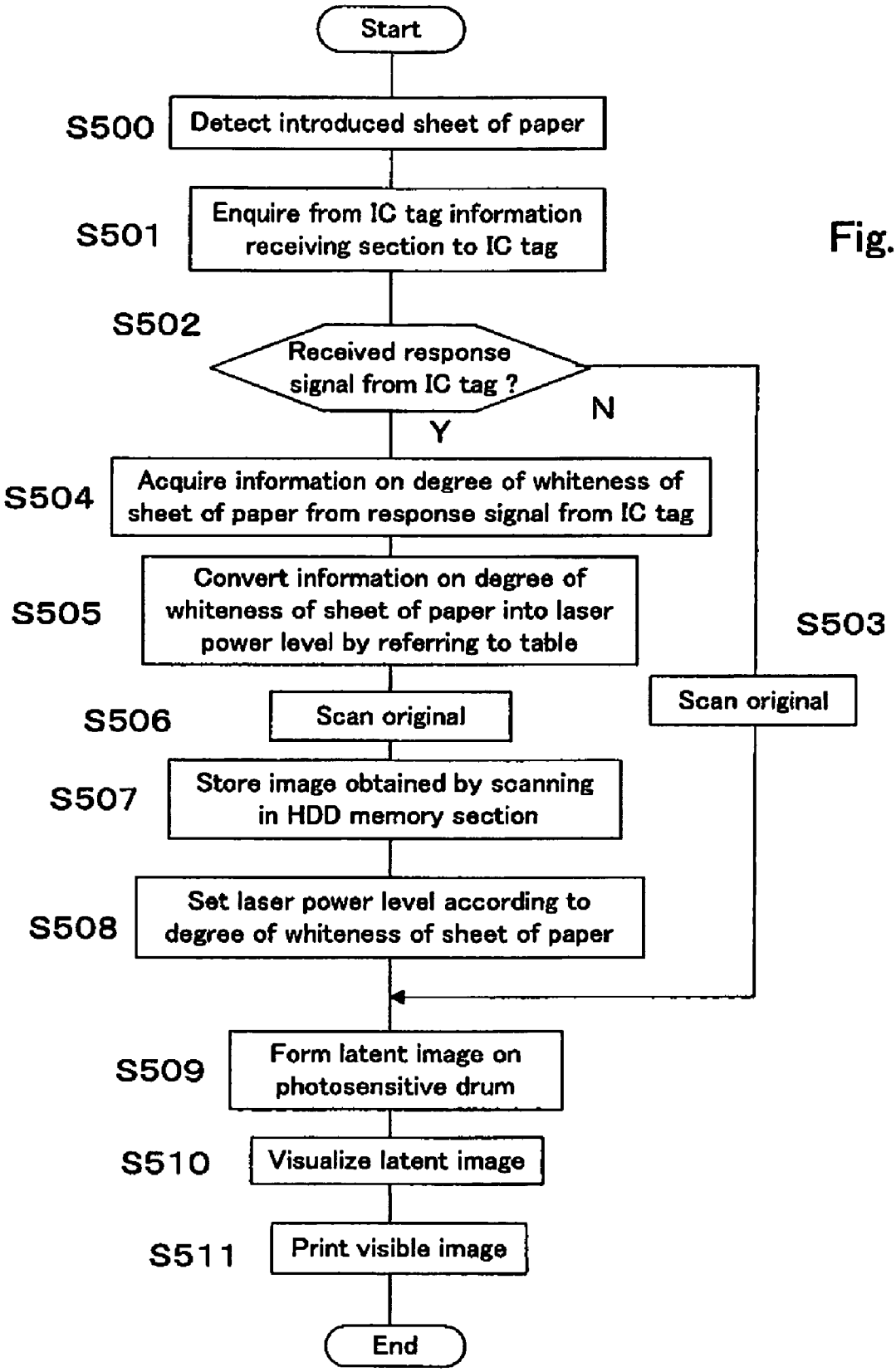
FIG. 5 is a flow chart of the operation of another embodiment of image forming apparatus according to the invention.

Now, the operation of this embodiment will be described below by referring to the flow chart of FIG. 5. The control sequence of the operation is roughly stored in the ROM section 307 and the system control section 313 controls the overall operation according to the control program stored in the ROM section 307.

In this embodiment, the IC tag 101 arranged at the upper left corner of the sheet of paper 102 stores information on the degree of whiteness of the sheet of paper 102 as a value between 1 and 5. The sheet of paper is whitest when the degree of whiteness is 5, whereas it is least white when the degree of whiteness is 1. The information on the degree of whiteness is then transmitted to the D/A converter 312 shown in FIG. 3 and converted into an analog value so as to be used for controlling the laser driver 311, changing the power of the laser emitted from the laser section 105 and modifying the printing density of the visible image. More specifically, the power of the laser is reduced when the degree of whiteness is close to 5, whereas the power of the laser is raised when the degree of whiteness is close to 1.

As the sheet of paper 102 is introduced from the sheet feeding cassette section 103, the system control section 313 detects the sheet of paper 102 by means of a detector (not shown) in Step S500. As the introduced sheet of paper is detected and if the sheet of paper carries an IC tag, the IC tag information receiving section 109 transmits an enquiry signal asking for attributes of the sheet of paper 102 to the IC tag 101 after the elapse of a predetermined time period when the IC tag information receiving section 109 is located closest to the IC tag 101 (Step S501).

If the sheet of paper 102 does not carry any IC tag, no response signal will be sent from any IC tag in response to the enquiry signal from the IC tag information receiving section 109 as a matter of course. Therefore, if the sheet of paper 102 carries an IC tag or not is detected in Step S403 depending on if a response signal is sent from an IC tag or not.

When no IC tag 101 is fitted to the sheet of paper 102, the system control section 313 determines that the sheet of paper shows a predetermined initial value for the degree of whiteness and moves to Step S503, where it conducts an ordinary printing operation of scanning the original, acquiring an optical image, converting it into an electrostatic latent image and then into a visible image that is to be performed on a sheet of a given predetermined degree of whiteness (Steps S509 through S511).

It may alternatively be so arranged that the system control section 313 displays a message asking for information on the degree of whiteness of the sheet of paper on the operation panel section 113 by way of the operation panel I/F section 304 so as to prompt the operator to input information on the degree of whiteness of the sheet of paper. Still alternatively, it may be so arranged that the system control section 313 measures reflectance of light irradiated onto the sheet of paper 102 and displays the message on the operation panel section 113 to ask the operator only when the reflectance is out of a permissible range. Still alternatively, it may be so arranged that the output power level of the laser driver 311 is automatically changed according to the reflectance of the sheet of paper 102.

If, on the other hand, there is a response signal transmitted from the IC tag 101 and received by the IC tag information receiving section 109, the system control section 313 acquires information on the degree of whiteness of the sheet of paper 102 out of the response signal from the IC tag 101 in Step S504. The acquired information on the degree of whiteness of the sheet of paper is then transmitted from the IC tag information receiving section 109 to and temporarily stored in the RAM section 308. The relationship between information on the degree of whiteness and the output power level of the laser driver 311 is stored typically in the ROM section 307 in the form of table on the degree of whiteness versus the power level relationship. The information on the degree of whiteness of the sheet of paper 102 stored in the RAM section 310 is then converted into a digital value of the laser power level by referring to the table on the degree of whiteness versus the power level stored in the ROM 307. The digital value is transmitted to the D/A converter 312 and converted into an analog value.

In this embodiment again, the IC tag 101 is arranged in one of the lateral non-printing areas 201*s* of the sheet of paper 102. The fixing rollers 112*a*, 112*b* are outwardly tapered in the areas thereof that correspond respectively to the non-printing areas 201*s* of the sheet of paper 102. Therefore, the IC tag 101 is not crushed by the paired fixing rollers 112*a*, 112*b* if the latter revolve in the respective directions indicated by arrows 200*a*, 200*b*. Additionally, since the IC tag information receiving section 109 is arranged near the passing route of the IC tag, it can efficiently receive the signal from the IC tag and hence it is possible to minimize the influence that the signal can exert on other appliances.

In the next step, or in Step S506, the scanning section 106 scans the original to be copied. The optical image that is obtained by the scanning operation is then converted into an electric image and, in Step S507, it is taken in by way of the scanner I/F section 301 and stored in the HDD memory section 308.

In Step S508, the laser driver 311 is driven to operate by the analog value set by the D/A converter 312. In other words, the laser section 105 is so set as to emit a laser beam with an intensity that corresponds to the degree of whiteness of the sheet of paper 102.

In the next step, or in Step S509, the image stored in the HDD memory section 308 is read out and the laser beam that is set in the above described manner is emitted so that an electrostatic latent image that corresponds to the read out image is formed on the photosensitive drum 107. The electrostatic latent image that is formed on the photosensitive drum 107 is then turned into a visible image typically by means of toner (Step S510).

In Step S511, the visualized toner image is transferred onto the sheet of paper 102 by printing under the control of the system control section 313.*by* way of the printing I/F section 302.

Thus, this embodiment provides an advantage that an image is printed on a sheet of paper that matches the degree of whiteness of the sheet of paper because the output power level of the laser section is controlled according to the information on the degree of whiteness of the sheet of paper stored in the IC tag arranged on the sheet of paper 102.

Information on the size of the sheet of paper to be used for printing is stored in the IC tag carried by the sheet of paper in the first embodiment and information on the degree of whiteness of the sheet of paper to be used for printing is stored in the IC tag carried by the sheet of paper in the second embodiment. However, both information on the size of the sheet of paper and information on the degree of whiteness of the sheet of paper may be stored in the same IC tag. Then, it is possible to define a plurality of optimal conditions in terms of the size of the sheet of paper and the degree of whiteness of the sheet of paper. It should be noted that the present invention is applicable so long as any attribute information on the sheet of paper to be used for printing is stored and the information may be on the type and/or the quality of the sheet of paper.

The above-described first and second embodiments are so arranged that the IC tag information receiving section 109 transmits an enquiry signal to the IC tag and receives a responding signal from the IC tag when the IC tag comes closest to the IC tag information receiving section 109. However, it may alternatively be so arranged that the IC tag constantly transmits a signal representing the attribute information on the sheet of paper and the IC tag information receiving section 109 receives signal.

While the IC tag is arranged near a lateral side of the sheet of paper in the above described first and second embodiments, the position where the IC tag is arranged is not limited thereto for the purpose of the invention. Furthermore, it is not necessary to arrange the IC tag information receiving section near the passing route of the IC tag for the purpose of the present invention.

While an image is printed on a sheet of paper in the above described first and second embodiments, the sheet to be used for printing is not limited to a sheet of paper and the present invention is equally applicable to a printing operation using a sheet other than a sheet of paper such as an OHP sheet. In other words, the present invention is applicable to any ordinary recording sheet.

The original is scanned to obtain an optical image, which optical image is then converted into an electric image, which electric image is controlled according to the attribute information of the recording sheet to be used for printing a corresponding image so as to make the printed image match the attributes) of the recording sheet in the above described first and second embodiments. However, an electric image may be directly obtained for the purpose of the present invention. In other words, it is not necessary to obtain an optical image.

The present invention is by no means limited to the above-described embodiments, which may be modified in various different ways without departing from the spirit and scope of the invention.

What is claimed is:

1. An image forming apparatus comprising:

an image acquiring section for acquiring the image to be printed;

an attribute information acquiring section for acquiring attribute information of a recording sheet to be used for printing the image acquired by the image acquiring section from an IC tag attached to the recording sheet and storing the attribute information;

a printing control section for controlling the operation of printing the image so as to make the image match the attributes of the recording sheet on the basis of the attribute information acquired by the attribute information acquiring section; and an image printing section for printing the image under the control of the printing control section, wherein the attribute information stored in the IC tag is on the size of the recording sheet, the attribute information acquiring section is arranged at a position off a printing area of the recording sheet and at the side where the IC tag is disposed in the passing route of the recording sheet, and the image printing section includes a pair of fixing rollers that are adapted to revolve, pinching the recording sheet between them, and produce a gap between themselves and the off printing areas of the recording sheet.

2. The apparatus according to claim 1, wherein the image to be printed is expanded or compressed according to the size of the recording sheet.

3. The apparatus according to claim 1, wherein the attribute information stored in the IC tag is on the degree of whiteness of the recording sheet.

4. An image forming apparatus comprising:

a scanner section for scanning the original to be printed to obtain an optical image;

an image storage section for storing an optical image obtained by scanning by means of the scanner section as an electric image;

an IC tag information receiving section for receiving attribute information on the attribute(s) of a recording sheet to be used for printing the electric signal stored in the image storage section as a visible image from an IC tag attached to the recording sheet;

an image control section for controlling the electric image according to the attribute information acquired by the IC tag information receiving section so as to make the image match the attribute(s) of the recording sheet;

a visible image forming section for forming a visible image from the electric image controlled by the image control section; and an image printing section for printing the visible image formed by the visible image forming section on the recording sheet, wherein the attribute information stored in the IC tag is on the size of the recording sheet, the IC tag information receiving section is disposed at a position off the printing area of the recording sheet and at the side where the IC tag is arranged in the passing route of the recording sheet, and the image printing section includes a pair of fixing rollers that are adapted to revolve, pinching the recording sheet between them, and produce a gap between themselves and the off printing areas of the recording sheet.

5. The apparatus according to claim 4, wherein image control section expands or compresses the electric image according to the size of the recording sheet.

6. The apparatus according to claim 4, wherein the attribute information stored in the IC tag is on the degree of whiteness of the recording sheet.

7. A recording sheet to be used for an image forming apparatus comprising an image acquiring section for acquiring the image to be printed, an attribute information receiving section for receiving attribute information of a recording sheet to be used for printing the image acquired by the image acquiring section, a printing control section for controlling the operation of printing the image on the basis of the attribute information received by the attribute information receiving section and an image printing section for printing the image under the control of the printing control section, the recording sheet comprising:

an IC tag storing the attribute information and adapted to transmit the attribute information to the attribute information receiving section on the surface thereof, wherein the IC tag stores the size of the recording sheet as attribute information of the recording sheet, and .

the IC tag is arranged at a position off the printing area of the recording sheet in the passing route of the recording sheet which is pinched by the pair of fixing rollers belonging to the image printing section and adapted to revolve so as to produce a gap between themselves and the off printing areas of the recording sheet.

8. The recording sheet according to claim 7, wherein the IC tag stores information on the degree of whiteness of the recording sheet as attribute information of the recording sheet.

* * * * *